US006658779B2

(12) United States Patent
Bauer et al.

(10) Patent No.: US 6,658,779 B2
(45) Date of Patent: Dec. 9, 2003

(54) WEAPON SYSTEM COMPRISING A FIREARM AND A NON-LETHAL MEANS FOR SELECTIVELY EJECTING A STREAM OF FLUID

(76) Inventors: Eran Nicodemus Bauer, Lodge Farm, Newark Road, North Disney, Lincoln LN6 9JP (GB); Gerard Miet Bauer, The Manor House, Barnes Lane, Wellingore, Lineoln LN5 0JB (GB); Michael Peter Moore, 14 Ullswater Close, Lightwater, Surrey GU18 5TD (GB)

( * ) Notice: Subject to any disclaimer, the term of this patent is extended or adjusted under 35 U.S.C. 154(b) by 0 days.

(21) Appl. No.: 10/150,177

(22) Filed: May 17, 2002

(65) Prior Publication Data

US 2002/0184809 A1 Dec. 12, 2002

Related U.S. Application Data

(63) Continuation-in-part of application No. 09/171,480, filed on Dec. 11, 1998, now abandoned.

(30) Foreign Application Priority Data

Apr. 19, 1996 (GB) ..... 9608205

(51) Int. Cl.[7] ..... F41C 9/00
(52) U.S. Cl. ..... 42/1.08; 222/79
(58) Field of Search ..... 42/1.08, 90, 106; 222/78, 79, 162, 325, 192, 175; 89/1.1, 1.11

(56) References Cited

U.S. PATENT DOCUMENTS

| | | | | |
|---|---|---|---|---|
| 1,269,922 A | | 6/1918 | Gadecki | |
| 1,299,076 A | | 4/1919 | Wasylowich | |
| 1,333,268 A | * | 3/1920 | Masaites | 222/192 |
| 1,347,509 A | * | 7/1920 | Howe | 222/192 |
| 2,629,516 A | | 2/1953 | Badham | |
| 3,415,420 A | | 12/1968 | White | |
| 3,730,390 A | | 5/1973 | Adrian et al. | |
| 3,938,708 A | * | 2/1976 | Burger | 222/95 |
| 4,058,921 A | | 11/1977 | Mason | |
| 4,153,927 A | | 5/1979 | Owens | |
| 4,316,338 A | | 2/1982 | Mason et al. | |
| 4,758,933 A | | 7/1988 | Winberg | |
| 4,777,754 A | | 10/1988 | Reynolds, Jr. | |
| 5,088,624 A | | 2/1992 | Hackett et al. | |
| 5,302,938 A | | 4/1994 | Martineau | |
| 5,388,728 A | | 2/1995 | Gueret | |
| 5,397,029 A | | 3/1995 | West | |
| 5,427,320 A | | 6/1995 | Mak et al. | |
| 5,497,911 A | | 3/1996 | Ellion et al. | |
| 5,605,259 A | | 2/1997 | Clawson | |
| 5,671,559 A | * | 9/1997 | Ludaesher et al. | 42/1.08 |
| 5,787,628 A | * | 8/1998 | Teetzel | 42/1.08 |
| 5,848,598 A | | 12/1998 | Walz | |
| 5,983,548 A | * | 11/1999 | Ludaescher | 42/1.08 |
| 6,050,454 A | * | 4/2000 | Ludaescher et al. | 222/162 |
| 6,196,419 B1 | | 3/2001 | Haney et al. | |

FOREIGN PATENT DOCUMENTS

| | | |
|---|---|---|
| EP | 130347 | 1/1985 |
| GB | 940209 | 10/1963 |

* cited by examiner

*Primary Examiner*—Michael J. Carone
*Assistant Examiner*—Gabriel S. Sukman
(74) *Attorney, Agent, or Firm*—Jackson Walker L.L.P.

(57) ABSTRACT

A weapon system comprising a firearm having a barrel through which a projectile may be propelled and further comprising a non-lethal means for selectively ejecting a stream of fluid, such as an incapacitant, in a direction substantially parallel to the axis of the barrel and aligned with the sights of the firearm. The system removably houses a fluid containing pressurized canister, the outlet of the canister co-operating with a nozzle for the release of said fluid from said canister under control of a nozzle trigger mechanism. The pressurized canister, nozzle and trigger mechanism may be removably mounted on said firearm.

7 Claims, 11 Drawing Sheets

WEAPON SYSTEM COMPRISING A FIREARM AND A NON-LETHAL MEANS FOR SELECTIVELY EJECTING A STREAM OF FLUID

This is a continuation-in-part application of U.S. patent application Ser. No. 09/171,480, filed Dec. 11, 1998 now abandoned.

FIELD OF THE INVENTION

This invention relates to a less than lethal weapons system, and particularly to the use of forward firing incapacitants with firearms.

DESCRIPTION OF THE PRIOR ART

As crime becomes increasingly violent, with more assailants carrying guns, knives and other potentially lethal weapons, there is a growing necessity for law enforcers to be armed with sufficient weaponry to be able to deal with violent incidents. In many countries police officers already carry guns as a matter of course. In this country some special units of the police force also carry guns.

Although an officer may carry a gun, he may only use reasonable force. Reasonable force does not always include shooting the assailant. Further more, in the case where an officer points a gun at an assailant, and threatens to shoot he only has threes option, those being to shoot to kill, shoot to injure, or to retreat. If he cannot do any of these he is faced with the prospect of carrying a live weapon, securable only with a safety catch, which he cannot use. In such case, an armed officer is disadvantaged because he cannot allow the assailant to take possession of the gun, but he cannot use it, so he is faced with the prospect of wrestling with the assailant whilst carrying a live weapon, possession of which he must retain.

It would therefore be desirable to provide an armed officer with the option of controlling the assailant in a less than lethal manner, such as by incapacitating the assailant.

Situations arise in other areas of law enforcement, such as peace keeping, where it is necessary for personnel to carry weapons, but where it is not always desirable to shoot an assailant. In such situations it would often be desirable for the officer to have a less than lethal option such as incapacitating an assailant.

Incapacitants such as CS, CR, CN, OC gas, and other similar products are know, and are used for policing and military purposes in some countries. These products are often used in riot control, but are also used by individual officers to incapacitate individual assailants or small groups thereof. When incapacitants are used in this manner, they are contained in small aerosol canisters which can be attached to a belt or an item of clothing. When the officer need to use the incapacitant, he simply takes hold of the aerosol and sprays the incapacitant in the direction of the assailant. This type of equipment works well for the unarmed officer. However, for the armed officer and in particular the armed officer who has already drawn his weapon, using such an aerosol presents problems.

In order to use the aerosol, the armed office must make safe and put down his gun. Then he must take the aerosol from its holder. This procedure necessitates that the officer either retreat from the assailant to allow himself time to put down his weapon and take hold of the aerosol, or put down his weapon and take hold of the aerosol in close proximity to the assailant. Both of these options present problems. The first provides the assailant with an opportunity to escape, whilst the second provides him with an opportunity to attack the officer.

It would therefore be desirable to provide the officer with a means of firing an incapacitant at an assailant without having to put down his weapon. Such a device is provided by the invention.

It would also be desirable to provide a device which can be used at night. One embodiment of the invention provides such a device.

It would be advantageous to provide a device adaptable to the conditions in which it is to be used. An embodiment of the invention provides such a device.

Incapacitants are commonly available in aerosol canisters, the dimensions of which vary. It would be desirable to be able to use canisters of different dimensions.

One weapon for discharging a bullet and a liquid is described in U.S. Pat. No. 1,299,076 in the name of Wasylowich. The purpose of the Wasylowich weapon is to spray a mist towards the enemy in the path of a bullet fired from the weapon, the mist generated obscuring from the enemy the weapon and solider using it. The firing of a liquid is not an alternative to firing a bullet, rather it is to conceal the firing of the bullet. To release the mist, the soldier must grasp a handle with one of his hands, and push forwards.

Another weapon for discharging a bullet and a liquid is described in U.S. Pat. No. 1,269,922 in the name of Gadecki. This weapon provides the user thereof with the options of delivering a bullet, or a blinding liquid. The liquid container is mounted under the barrel on the fore-end of the weapon. The liquid is released by firing off a spring loaded handle element which slides in a slot. The handle element is difficult to operate, apparently requiring the hand operating the bullet releasing trigger to be moved off that trigger, and forwardly to the vicinity of the handle, and then to push forwardly on the handle to release the blinding fluid. This has two disadvantages. First, the assailant is able to see which resource the marksman is to use, and second the time taken to move the trigger hand forward and re-position the other hand to support the gun, provides an assailant with an opportunity to attack the user of the weapon.

Another weapon for discharging a bullet and a liquid is described in U.S. Pat. No. 5,671,559 in the name of Ludaesher et al. The weapon described includes a source of incapacitant fluid in the form of an aerosol canister mounted below the fore-end of a pistol. A plunger button for releasing the incapacitant fluid is provided adjacent the trigger guard. Hence the firing of a bullet or an incapacitant is controlled by the same trigger finger. Whilst Ludaesher provides the option of firing either bullet or liquid incapacitant, once the operator has decided which option to use, he is committed to that option for a period of time. Furthermore, the action of pushing forwards with the trigger finger to release the incapacitant spray is an unnatural one, thereby making use of the weapon difficult. The action of pushing a trigger forwards may in fact unbalance the weapon.

All of the prior art devices result in an unnatural firing action by the operator. In each of them, the operator is required to push the fluid release trigger, which in the operation of firearms is not a natural action. Further, some of the prior art devices are difficult to handle, requiring the operator to re-position his hands prior to firing the liquid. Additionally, the prior art devices fail to provide for the simultaneous firing of incapacitant liquid or a bullet.

OBJECT OF THE INVENTION

The invention provides a less than lethal weapons system comprising a gun having a barrel through which a projectile may be propelled, and means for selectively ejecting a stream of fluid in a direction substantially parallel to the axis of the barrel.

The invention provides a means for selectively ejecting a stream of fluid which means is releasably attachable to a gun.

The means for selectively ejecting a stream of fluid maybe formed as an integral part of the gun.

Preferably, the means for selectively ejecting fluid is aligned with the sights of the gun to which it is attached, so that fluid is ejected towards the point of aim of the gun.

Preferably, the means for selectively ejecting fluid and a fluid supply comprise a pressurized vessel and a valve, which may be in the form of a pressurized canister such as an aerosol canister. The aerosol canister may comprise a bag containing fluid to be ejected, which bag is sealed around a valve and pickup tube, the bag being mounted within a canister and the remaining space being filled with a propellant which acts on the bag to eject fluid out of the tube. Alternatively, the means for selectively ejecting fluid comprises a pump and the fluid supply comprises a reservoir, such as a bag or a tank. The bag or tank may be remote from the means for selectively ejecting fluid.

Preferably, there is provided a nozzle through which fluid is ejected. The nozzle maybe interchangeable or adjustable, and maybe selected or adjusted to produce a spray pattern suitable for the circumstances in which the weapon is to be used. Preferably, the weapon can produce a spray pattern having a diameter between 0.001 m to 5 m, and more preferably, the spray pattern is sufficiently large to cover the head and shoulders of the person targeted. The spray may range from a narrow jet of fluid to a mist of fluid. The nozzle may be adjusted or selected to eject the fluid within a range of 0 to 5 m from the nozzle. The nozzle suitable provides for the direction of fluid passing therethrough to be changed.

The means for selectively ejecting a stream of fluid may comprise a trigger mechanism, which is suitably provided with a safety catch.

The gun may be a pistol, a rifle, or a shotgun. The pistol, rifle or shotgun may be automatic or semi-automatic weapons.

The invention provides an attachment for a gun, comprising a housing in which a fluid containing pressurized canister is mounted, the outlet of the canister co-operating with a nozzle to release fluid from the said canister. A trigger mechanism may be provided to control the release of fluid from the canister.

One embodiment of the invention provides a fluid ejection means for selectively ejecting a stream of fluid comprising a mounting means suitable for mounting a pressurized vessel, such as an aerosol canister to a gun.

Advantageously, the fluid ejection means is releasably attachable to the gun. The pressurized vessel maybe mounted in or be an integral part of the fluid ejection means. Preferably, when the fluid ejection means is attached to the gun the longitudinal axis of the pressurized vessel is at an angle of between 0 and 90 degrees to the longitudinal axis of the barrel of the said gun. In one embodiment of the invention the longitudinal axis of the pressurized vessel is at an angle of 75 degrees to the longitudinal axis of the barrel of the said gun.

The pressurized vessel may be removably inserted into the mounting means. A nozzle maybe provided to co-operate with the outlet of the pressurized vessel so that moving the nozzle towards the vessel depresses the outlet thereof causing release of the contents of the vessel.

Preferably, the outlet of the pressurized vessel has fluid releasing and retaining positions with means of biasing, e.g. a spring, the said outlet to the retaining position being provided.

The nozzle may be biased away from the outlet of the pressurized vessel, for example by means of a spring.

Preferably a trigger mechanism comprising a lever is provided which when depressed pushes the nozzle against the outlet of the pressurized vessel to release the contents thereof. With the nozzle being biased away from the outlet of the pressurized vessel, either by the outlet or a separate biasing means, the lever is pushed to its rest position when the lever is released. Pressure on the lever may be exerted by a user's thumb or one of his fingers.

Advantageously, the mounting means comprises a housing. The housing may replace, or be attached to the fore-end of a gun. The housing is preferably releasably attachable to the gun. The housing may be provided with a connector adapted to slide into a rail provided on the fore-end of the gun for releasable attachment of the housing to the gun.

In one embodiment of the invention at least one pin may be used to hold the housing in place on the gun. One end of the housing may be adapted to slide into a part of the gun.

Preferably the housing comprises means to retain the ends of a pressurized canister, which means may constrain lateral and longitudinal movement of the canister. At least one of the means may be a slidably removable spacer, which is insertable between an end of the canister and a part of the housing, where upon removal of the spacer the said canister is released to allow removal thereof and replacement with a fresh canister. Preferably, between the part of the housing with which the spacer co-operates and the spacer there is provided a spring. The spring biases the canister towards the means to retain the other end of the canister thereby preventing longitudinal movement of the canister within the housing. The spacer may be provided with a protrusion which co-operates with the side of the canister to prevent lateral movement thereof. Providing a selection of sizes of spacer enables canisters of different sizes to be used.

In one embodiment of the invention, one end of the housing is threaded and the canister is held in the housing by means of a screw cap. Preferably, when a canister is in the housing, turning the screw cap moves the canister either towards or away from the nozzle and trigger mechanism. Furthermore, the provision of a screw cap allows canister of different dimensions to be held in the housing.

The screw cap may be provided with a convex surface. Most aerosol canisters have a concave base. In use, the convex surface co-operates with the concave base of the aerosol canister to ensure that the canister is held in the correct position in the housing.

A nozzle may be slidably mounted at the end of the housing closest to the breach, a part of the nozzle preferably passing through an aperture in the housing. The range of movement of the nozzle may be limited. Preferably, a part of the housing defines a cylinder, in which the nozzle moves. The nozzle may be provided with an enlarged portion of the nozzle to slide on the inner surfaces of the said cylinder.

The housing preferably comprises a trigger mechanism which may comprises a lever pivotally mounted on the housing. One end of the lever maybe provided with a member which acts on the nozzle, so that when the other end of the lever is pushed or pulled, preferably pushed, the nozzle is forced towards the canister, depressing the outlet thereof releasing the fluid contained therein.

The lever of the trigger mechanism may be mounted on either or both sides of the housing. Alternatively, the lever of the trigger mechanism may be mounted substantially towards the centre of the housing.

Preferably forward movement of the nozzle is limited by the trigger mechanism, and rearward movement of the nozzle is limited by a protrusion extending inwardly from the inner surface of the cylinder. The protrusion may be a clip located in a grove in the inner surface of the cylinder. A spring is preferably located between the nozzle and the said protrusion. The spring may be a coil spring.

It is preferable to provide a safety catch to prevent the trigger mechanism being operated. The safety catch may lock the lever of the trigger mechanism. Alternatively, the safety catch may lock the lever of the trigger mechanism. Alternatively, the safety catch may lock the nozzle, preventing movement thereof when the lever is pressed. Means to move the safety catch between a safe position, where the release of the contents of the canister is prevented, and an unsafe position, where the release of the contents of the canister is permitted may be mounted on either or both sides of the housing.

A light unit maybe provided and is preferably mounted on the housing.

Preferably the light unit is aligned with the sights of the gun,

The fluid may be an incapacitant such as incapacitants known in the art as CS, CN, CR or OC gas. The fluid may contain a marker, such as a dye. The fluid may be harmless, which is preferably used for the purposes of training users of guns equipped with a device according to the invention.

The invention provides a particularly advantageous solution to the increased level of violence faced bylaw enforcers. By providing a weapons system having a less than lethal capacity, the marksman using a weapon according to the invention is provided with a less than lethal option for establishing control over an assailant. This will reduce the number of law enforcers who are charged with using unreasonable or excessive force. Costs to law enforcing authorities will be reduced since the number of enquiries held after shooting incidents will be reduced. Also the trauma faced by the marksman whose role it is to shoot criminals will be reduced, because they will not need to shoot when they are in doubt as to the severity of the threat posed by the assailant. Use of the weapon will also reduce the number of criminals who are killed or injured, thereby saving valuable medical resources. Soldiers involved in peace-keeping roles will be able to control members of potential warring factions without killing them. This is important, as when a peace-keeper kills a member of one faction he is seen to be taking the side of the other faction. This underlines the authority of the peace-keeper.

The personal risk faced by a law enforcer using a weapon according to the invention is considerably reduced. This is because there is no need to wrestle with the assailant if shooting him is not considered a suitable option. This has two effects, both of which are due to the fact that the weapon increase the distance between the law enforcer and the assailant at which control can be established. The first effect is that the law enforcer does not face a physical battle in which the assailant may produce a knife. The second is that the law enforcer does not need to worry about the assailant taking control of the weapon, because the assailant is kept at a distance. The benefit of these advantages is multiplies where the assailant is physically more powerful than the law enforcer. The number of law enforcers who are killed or injured in the course of their duties will be significantly reduces by the introduction of this invention.

There is significant advantage in providing a releasably attachable means for selectively ejecting a stream of fluid, which means is suitable for attachment to a gun. For instance, all guns owned by a police force need not necessarily be less than lethal weapons systems according to the invention. Officers could be issued with means for selectively ejecting a stream of fluid according to the invention for attachment to their guns. This would save costs. Furthermore, the means for selectively ejecting a stream of fluid according to the invention for attachment to a gun may be used as a hand held device for delivering an incapacitant, when not attached to a gun. This further increases the flexibility of the police force.

The invention aims to provide a weapon which can be used in two different ways. It is an object of the invention to provide a weapon including a firearm from which a potentially lethal projectile may be fired, in the conventional manner, and from which a non-lethal incapacitant can be released.

It is an object of the invention to provide a weapon where the marksman can at any moment chose between releasing the incapacitant or the projectile without changing the position of his hands on the weapon.

It is another object of the invention to utilise the natural tendencies of the human body to provide separate triggers for releasing incapacitant and a bullet which are actuated by closing a digit of a hand into the hand, to thereby squeeze the trigger.

It is a further object of the invention to provide a simple and inexpensive manner of releasably mounting an aerosol canister in a housing.

BRIEF DESCRIPTION OF THE DRAWINGS

In the drawings, which illustrate exemplary embodiments of the invention.

DETAILED DESCRIPTION OF THE DRAWINGS

Figure 1:
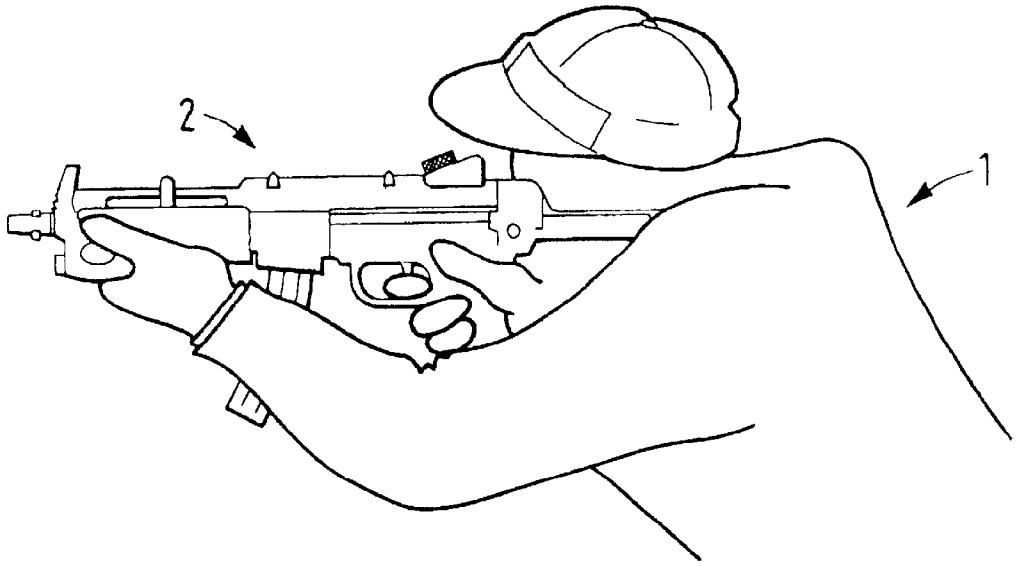
FIG. 1 shows a semi-automatic rifle provided with a fluid ejection means according to the invention in use.
Figure 2:
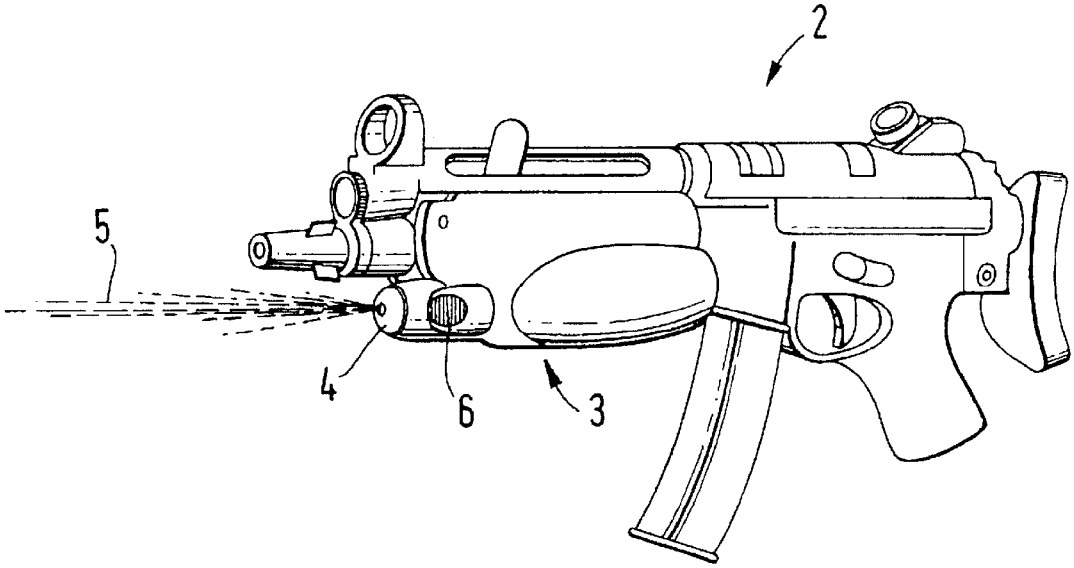
FIG. 2 shows a semi-automatic rifle provided with a fluid ejection means according to the invention.

FIGS. 1 and 2 illustrate a semi-automatic weapon 2, to which there is attached a housing 3 comprising a nozzle 4 through which a jet of fluid may be ejected, the ejection thereof being controllable by trigger 6. In FIG. 1 the weapon 2 is held in a firing position by a marksman 1.

Figure 3:
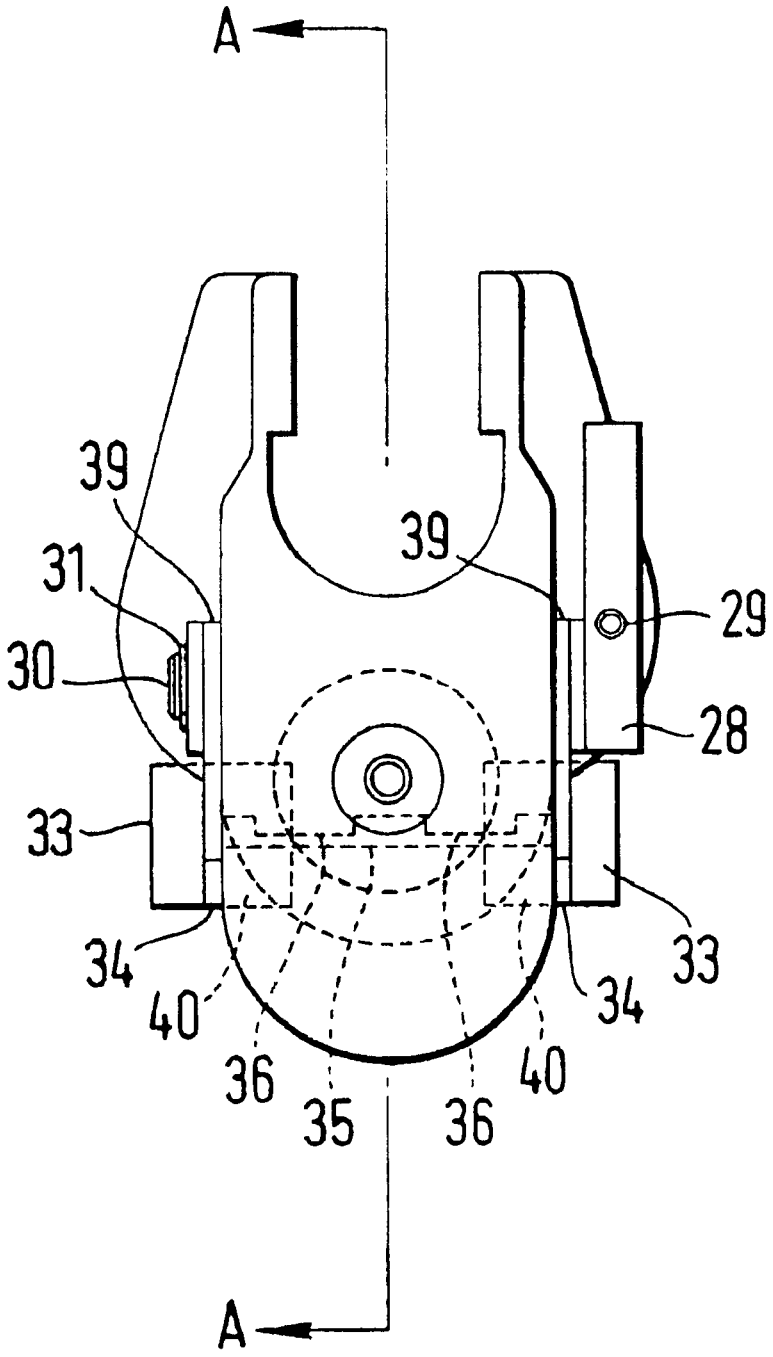
FIG. 3 is a front view of a housing comprising a fluid ejection means according to the invention.
Figure 4:
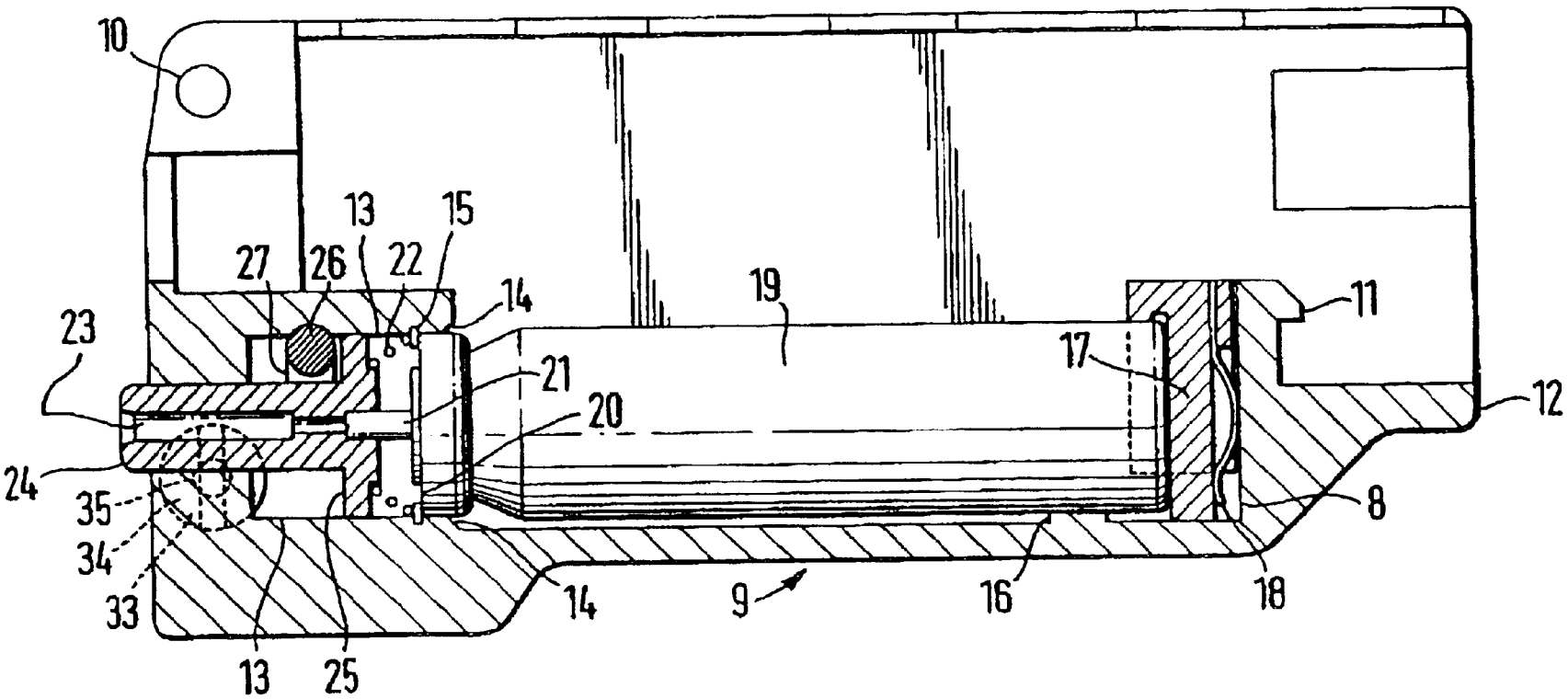
FIG. 4 is a sectional view along line A—A, of the device shown in FIG. 3.
Figure 5:
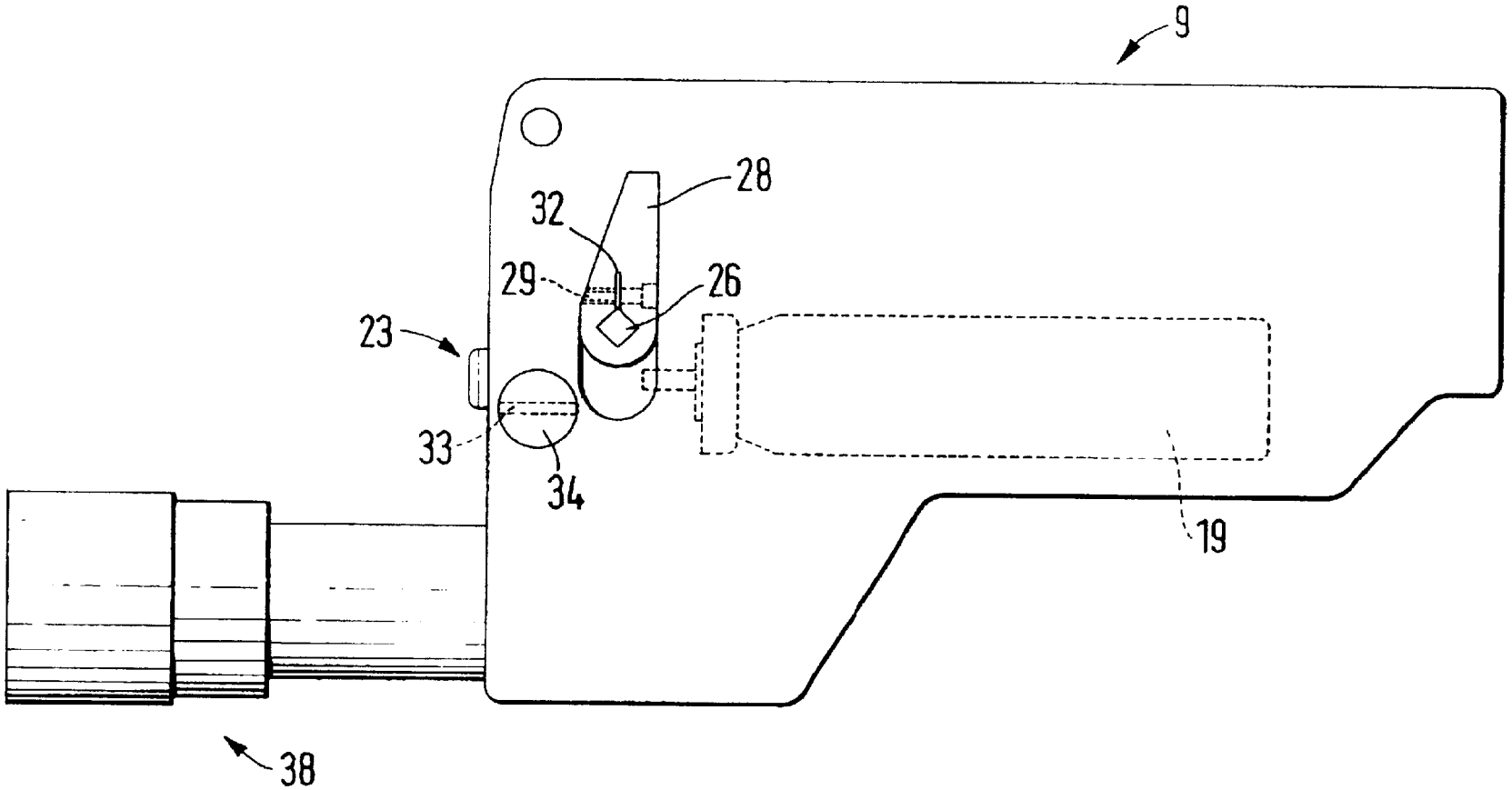
FIG. 5 is a side view of a housing comprising a fluid ejection means according to the invention.
Figure 6:
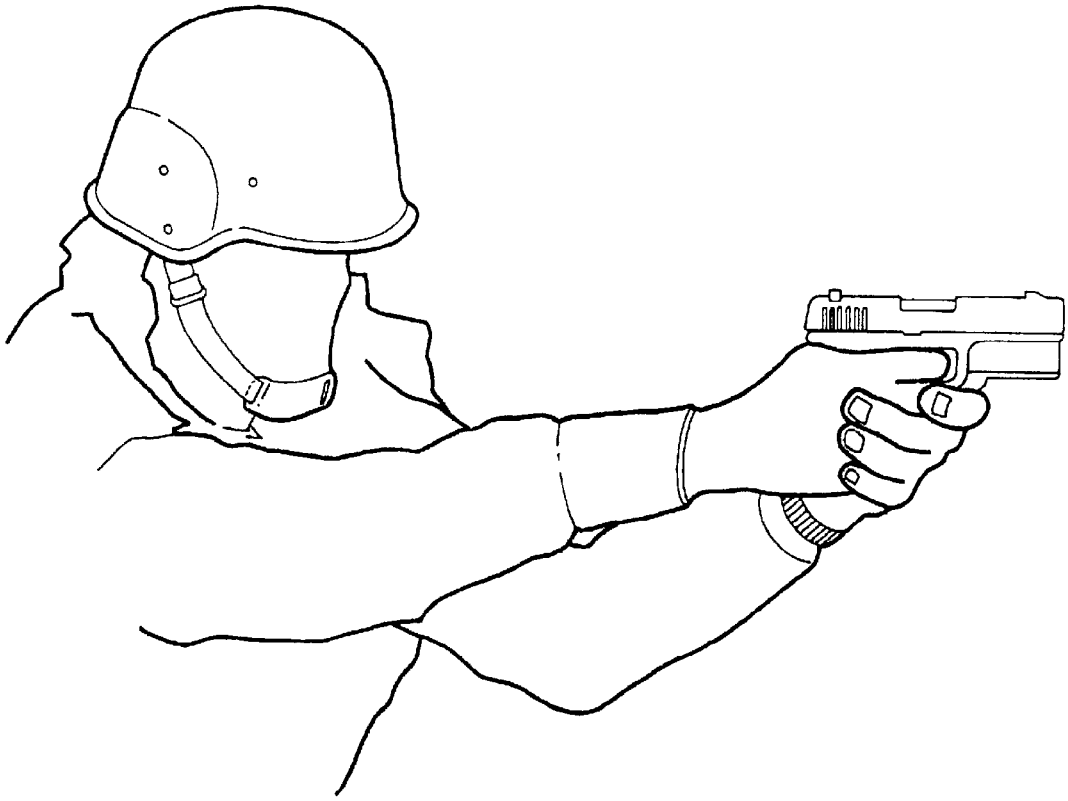
FIG. 6 shows a hand gun provided with a fluid ejection means according to the invention in use.

In the FIGS. 3 to 5 there is shown a housing generally indicated at 9. The housing 9 maybe made from any suitable metal or plastics material, and is formed in a casting process.

Housing 9 is adapted to replace the fore-end of the gun to which it is to be attached. At the rearmost end of the housing 9, the base portion 12 thereof is adapted to slidably engage a protruding part of the gun to which the housing is to be attached. Lip 11 is provided to limit vertical movement of the housing 9 when fitted to the gun. Housing 9 is locked in place by a pin which passes through aperture 10 and locates in a corresponding aperture in the gun to which the housing is attached. The upper part of the housing fits around the barrel of the gun.

Housing 9 is provided at its front end with cylinder 13, the rear corners 14 of which are chamfered. A groove is provided on the inner surface of cylinder 13. A circular spring clip is releasably retained in the said groove. The clip 15 together with the inner surface of cylinder 13 to the rear of clip 15 form a first means to retain aerosol canister 19. Aerosol canister 19 is a standard aerosol canister, which is well known in the art and is therefore not described in detail. Housing 9 can accommodate different sizes of canister.

Canister 19 is held in place by spacer 17, which is provided with a lip which co-operates with the side of canister 19 to prevent lateral movement thereof, and is biased towards the base of the canister 19 by spring 18 which is mounted on and acts against wall 8 of housing 9. Alignment of canister 19 within housing 9 is assured by protrusion 16 upon which canister 19 rests. To provide for the accommodation of different sizes of aerosol, a spacer 17 of different size may be used.

The base of cylinder 13 is provided with an aperture 23, in which nozzle 24 is slidably mounted. An enlarged portion 25 of nozzle 24 slides within cylinder 13. Aperture 26 runs through nozzle 24. The diameter of aperture 26 varies along its length. The rearmost end of aperture 26 is adapted to receive outlet 21 of aerosol 19, chamfering enabling easy insertion of outlet 21 into aperture 26. A coil spring 22 is mounted between the front most surface of clip 15, and the rearmost surface of enlarged portion 25 of nozzle 24. The function of spring 22 is to bias nozzle 24 away from outlet 21.

The trigger mechanism comprises a pivot member 26 mounted forwardly of enlarged portion 25 of nozzle 24 on removable side plates 39. Firing pins 27 extend downwardly from pivot member 26 on either side of nozzle 24 and within cylinder 13. Trigger lever 28 is mounted on the right-hand end of pivot member 26. As can be seen from FIG. 5, the end of pivot member 23 is diamond shaped, so that movement of trigger lever 28 causes pivoting of pivot member 26 about its own axis. This in turn causes firing pins 27 to push against the forward surface of enlarged portion 25 of nozzle 24, thereby pushing nozzle 24 rearwardly. This in turn pushes outlet 21 into canister 19, which releases pressurized fluid therefrom. Screw 29 co-operates with an aperture in vertical member 32 which extends from pivot member 26. Trigger lever 28 is provided with an aperture adapted to receive vertical member 32. The left-hand end of pivot member 26 is provided with a head 30 and is held in place by a clip 31. The trigger mechanism can be adapted for left-handed use by removing screw 29. This allows trigger lever 28 to be slid off pivot member 26. After removal of the nozzle 24 pivot member 26 can be removed by removing side plates 39. These parts can then be reassembled with the trigger lever on the left-hand side of the housing 9.

A safety catch 34 is arranged to lock the nozzle in place. Safety catch 34 comprises a slidable shaft 35, each end of which is releasably attachable to a plate 34 provided with extension 33, and slidable within chambers 40. In the safe position shaft 35 co-operates with an indent in nozzle 24, thereby preventing movement thereof. As is illustrated in FIG. 3, slidable shaft 35 has a portion 36 of reduced thickness. Pressing on extension 33 moves shaft 35 side ways, moving portion 36 of shaft 35 to a position beneath nozzle 24, and essentially centred on the centre line of nozzle 24. This permits nozzle 24 to move when actuated by the trigger mechanism. A spring means may be provided in chamber 40 to bias plate 34 outwardly, and hence shaft 35 into a position where it co-operates with the indent in nozzle 24 to prevent movement thereof. The provision of plates 34 at both ends of shaft 35 enables the safety catch to be operated by right or left-handed users.

FIG. 5 shows housing 9 equipped with a tactical light unit 38, which may be aligned with the sights of the gun to which housing 9 is to be mounted.

To replace an aerosol 19, the pin must be removed from aperture 10, thereby allowing housing 9 to be pulled away from the rest of the gun. Spacer 17 is then removed which allows canister 19 to be moved rearwardly and removed from housing 9. A fresh canister 19 is then installed, first moving the outlet end thereof into co-operation with the inner surfaces of cylinder 13, and rear surface of clip 15. Spacer 17 is then inserted between spring 18 and the base of canister 19. Housing 9 is then re-attached to the gun by means of lip 11, end portion 12 and the pin which co-operates with the aperture 10 in housing 9 and the gun.

To remove nozzle 24, canister 19, clip 15 and spring 22 must be removed, and the safety catch must be moved into its unsafe position.

Figure 7:
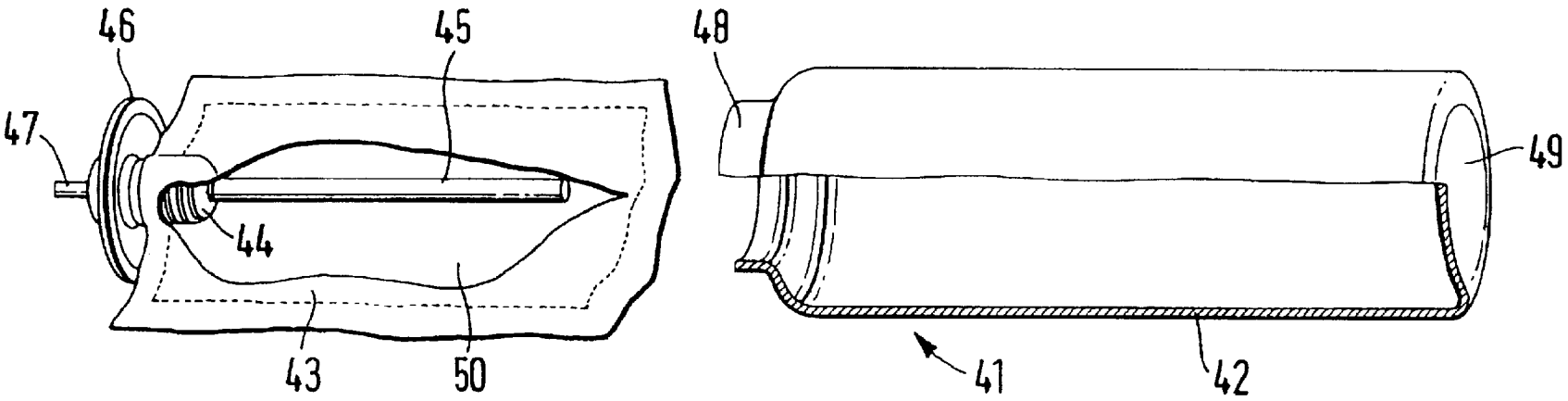
FIG. 7 illustrates an aerosol canister for use with a fluid ejection means of the invention.

Referring now to FIG. 7, there is shown a canister 41 comprising a can 42 having a collar 48, a base 49, and a bag 43 having a tube 45 therein, one end of the tube being connected to a valve assembly 44 to which is connected an outlet 47. Around valve assembly 44 there is fitted a cap 46. Bag 43 contains a fluid 50 to be ejected through outlet 47. The bag 43 is inserted into can 43. A propellant fills the space between the bag 43 and the can 42. Cap 46 fits into the collar 48 of the can 42 to provide a sealed aerosol canister. This type of aerosol canister is available from IDC Systems AG of Switzerland.

The aerosol canister shown in FIG. 7 is particularly useful because the canister need not be held upright to ensure ejection of the fluid 50. This is because the propellant squeezes the bag 43 thereby pressurizing it contents forcing them up the tube 45 and out of outlet 47 when the outlet is depressed. Hence, if an assailant is above or below the officer he can still fire the weapon thereby causing fluid to be ejected onto the assailant. Aerosols which do not contain the fluid in a bag may fail to eject the contents thereof if not held substantially vertical, whereas the aerosol canister shown in FIG. 7 functions irrespective of the angle at which it is held.

Figure 8:
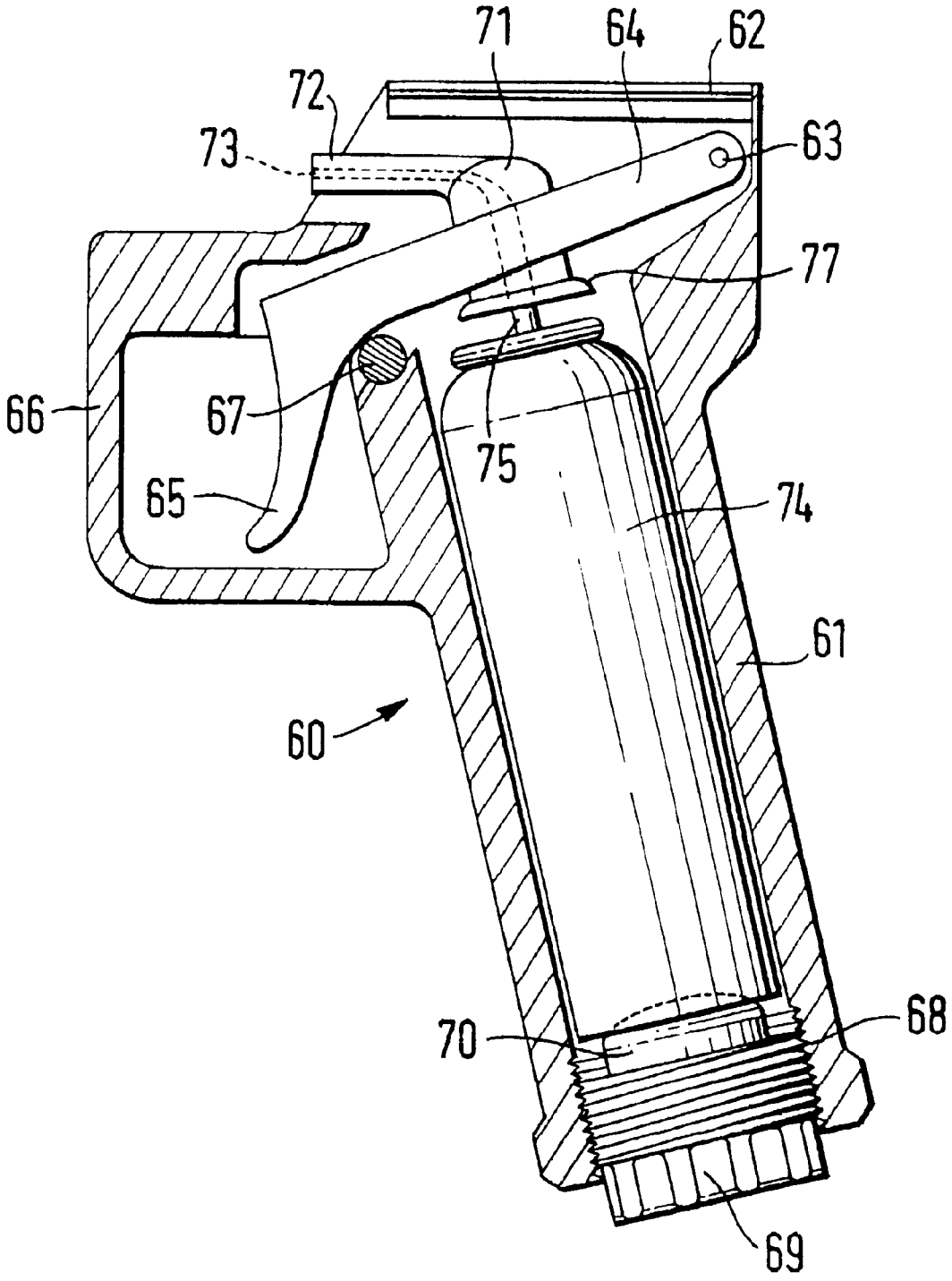
FIG. 8 is a cross-section of a fluid ejection means according to the invention.
Figure 9:
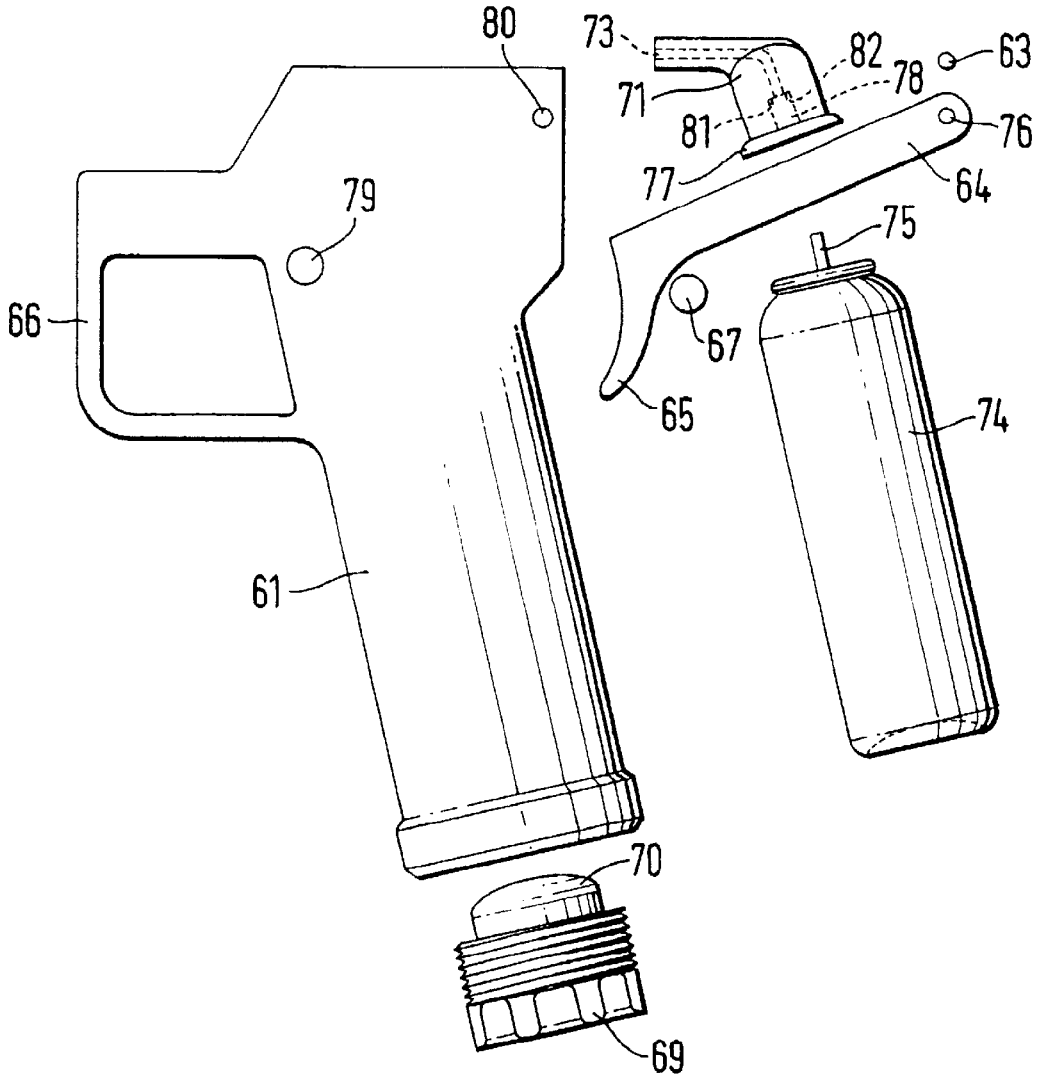
FIG. 9 is an exploded view of the components of the fluid ejection means shown in FIG. 8.
Figure 10:
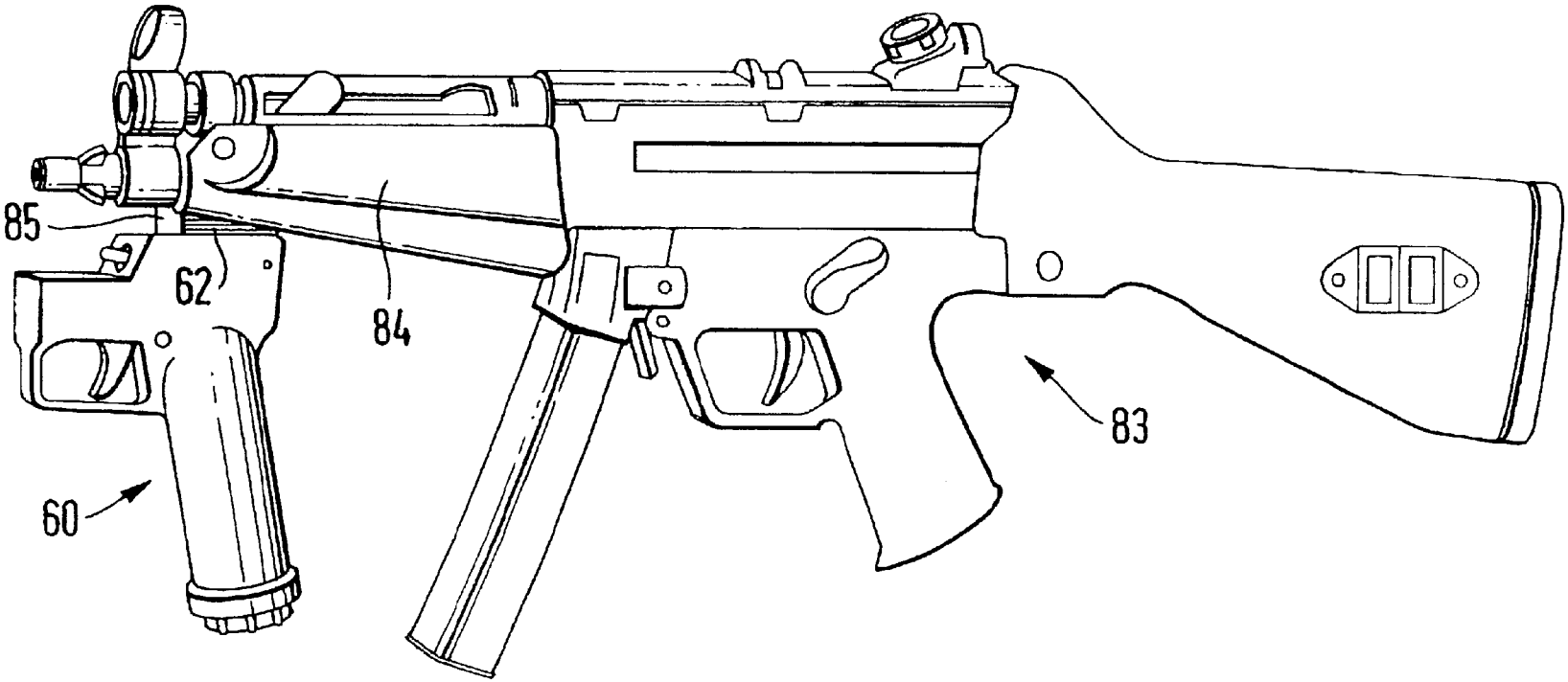
FIG. 10 is a schematic representation of a rifle and the fluid ejection means shown in FIGS. 8 and 9.

FIGS. 8 to 10 show a fluid ejection means 60 comprising a mounting means in the form of a housing 61 to mount a pressurized canister 74 to a rifle 83. The housing 61 mounts a trigger 64 which is pivotally attached to the housing by means of a pin 63 which passes through holes 76 and 80 in the trigger and housing respectively. Trigger 64 has a portion 65 which is shaped to accommodate a finger. The longitudinal axis of the canister 74, i.e. the axis extending from the nozzle to the base of the canister, is at an angle of approximately 15 degrees to the vertical. Such an angle is sufficiently close to the vertical to permit the contents of most aerosol canisters to be ejected properly.

Housing 61 also comprises a trigger guard 66 and an elongate connector 62 which is so shaped and dimensioned as to fit into or onto a rail forming part of the fore-end of a gun.

As is best shown in FIG. 8, a canister 74 fits into the body of housing 61 and is held in position by threaded cap 69, the said threads engaging with threads 68 of housing 61. By twisting cap 69, the canister can be raised or lowered, and furthermore, different sizes of canister can be used.

Nozzle 71 passes through a space, which may be an aperture, in trigger 64. A lip 77 around the base of nozzle 71 prevents the nozzle from being pushed through the said space. Nozzle 71 may be secured in the trigger 64, and may be releasably secured therein.

As can be seen from FIG. 9, nozzle 71 comprises an outlet aperture the diameter of which increase to form a cavity 78 having faces 81 and 82. When the fluid ejection means 60 is assembled as shown in FIG. 8, the domed end 70 of cap 69 pushes the canister 74 upwards such that the upper rim of outlet 75 engages with the faces 81 and 82 of cavity 78. When shaped portion 65 is depressed, the trigger 64 pivots about pin 63 moving the nozzle towards the canister 74 which causes the faces 81 and 82 to push the outlet 75 into the canister 74 thereby releasing fluid through cavity 78 and aperture 73. Outlet 75 is biased to a fluid retaining position. When pressure on the shaped portion 65 is released, the outlet 75 moves upwards pushing the trigger upwards and preventing the flow of fluid out of the canister 74 and hence nozzle 71.

The canisters of most commonly available aerosol incapacitants have concave bases. The domes end 70 of cap 69 also co-operates with the concave base of the canister held in housing 61 to ensure that the canister is held substantially centrally therein. The domed shape of cap 69 and the provision of threads 68 enables different shapes of canister to be used in the same fluid ejection means 60.

A safety catch 67 passes through an aperture 79 in the housing 61. The safety catch 67 may have a cut away portion and maybe rotatable, so that when rotated to a firing position the trigger 64 can move into the space provided by the cut-away portion, but when in a safe position the surface of the safety catch prevents movement of the trigger 64.

FIG. 10 show a rifle 83 having a fore0grip 84 with a rail 85. Fluid ejection means 60 slides onto rail 85 of the fore-grip 84 of the rifle 83.

Placing the trigger at the fore-end of the gun makes its use simpler, and its mis-use less likely. If the trigger controlling release of fluid is close to the bullet/shot firing trigger, and the two triggers are designed to be operated by the same hand, there is a greater chance of the person firing the weapon to select the wrong trigger. The result of selecting the wrong trigger could of course lead to a fatality.

The fluid ejection means 60 shown in FIGS. 8 to 10 can be sold separately from the rifle 83, thereby allowing the weapon to be updated rather than replaced. The fluid ejection means 60 may also be attached to a pistol.

The fluid ejection means may also be used separately when not attached to a gun, as a hand held device for delivering and incapacitant.

Figure 11:
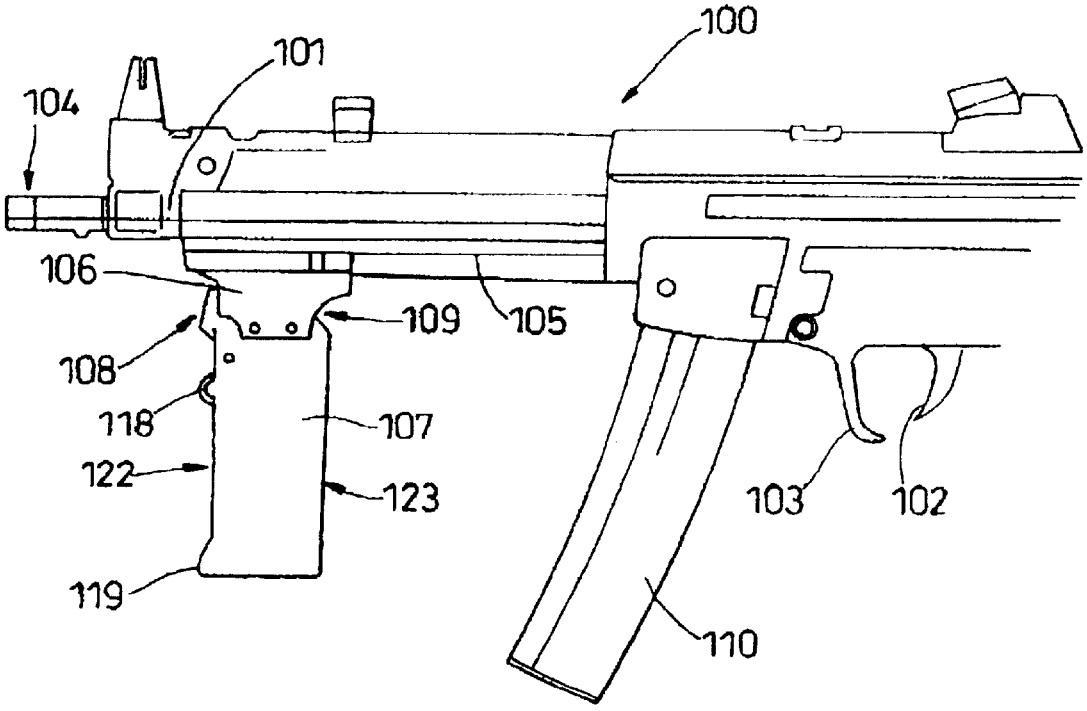
FIG. 11 is a side view of a semi-automatic rifle provided with a fluid ejection means according to one embodiment of the invention.

Referring now to FIG. 11, there is shown a semi-automatic weapon 100 (hereinafter referred to as the weapon) comprising a barrel 101 having a muzzle 104, a trigger 102, a trigger guard 103, and a magazine 110 in which rounds of ammunition are stored until such time as a marksman (not shown) pulls the trigger 102 to fire off one of the rounds of ammunition stored in the magazine 110. On firing off one of the rounds of ammunition, the projectile part of the round travels through the gun barrel 101 and out of the muzzle 104.

The weapon 100 further comprises a fore-rail 105 for the attachment of various components thereto. The embodiment of the invention shown in FIGS. 11 to 13 utilises the fore-rail 105 of the weapon 100 as opposed to replacing the fore-end of the weapon.

Figure 12:
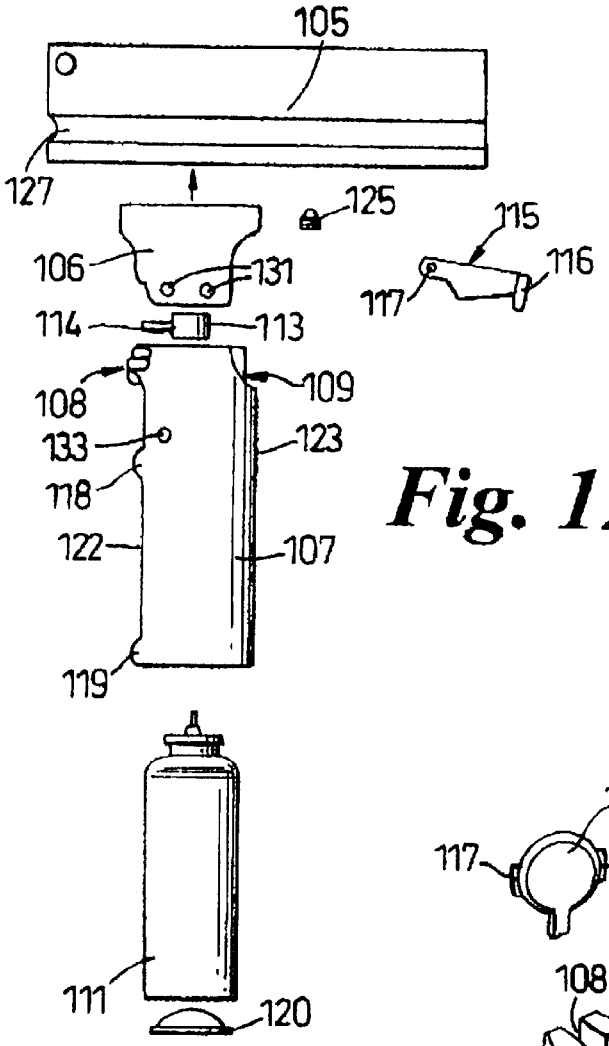
FIG. 12 is an exploded side view of component parts of the embodiment of the invention shown in FIG. 11.
Figure 13:
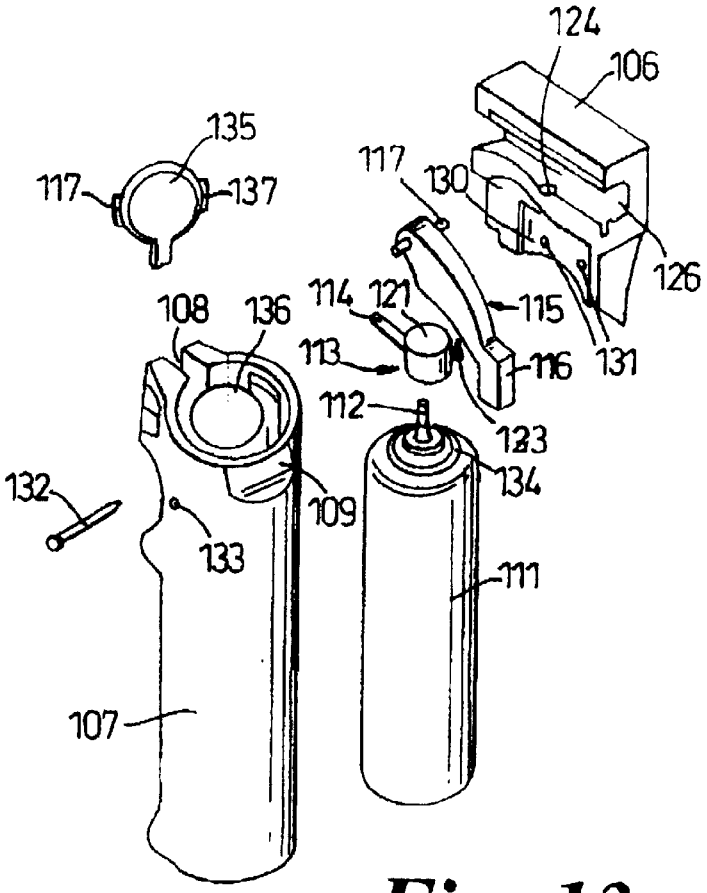
FIG. 13 is an exploded schematic representation of the embodiment of the invention shown in FIGS. 11 and 12.

The fluid ejection mechanism of the invention shown in FIGS. 11 to 13 comprises a housing 107 in which a canister 111 is removably mounted, an opening 108, and an opening 109. A bracket 106 mounts the housing 107 to the fore-rail 105.

The components of the fluid ejection means referred to above will now be described in greater detail with reference to FIGS. 12 and 13.

The housing 107 includes a chamber which receives the canister 111. A removable end cap 120 secures the canister 111 in the housing 107. The end cap may clip into the base portion of the housing 107, or alternatively, the end cap 120 and the base portion may be threaded. The end cap may be of the same constriction as the end cap 69 described with reference to FIGS. 8 and 9.

The canister 111 maybe secured in place by a transverse pin 132 passing through the bore 133, the pin engaging the underside 134 of a lip of canister 111. Such a construction allows the end cap 120 to be omitted, thereby simplifying construction.

A nozzle 113 fits in an end portion of the housing 107 proximal the rail 105. The nozzle 113 includes an outlet tube 114. As best seen from FIG. 13, the base of the nozzle is arranged to engage with the outlet 112 of the canister 111. As previously mentioned, the outlet 112 is movable between fluid retaining and fluid releasing positions, and is biased to the fluid retaining position. When the nozzle 113 is pressed downwards on the outlet 112, the outlet is moved to its fluid releasing position, and fluid flows out of the canister 111, through an aperture in the nozzle 113 and out of the outlet tube 114.

One possible construction of the nozzle 113 is that of the nozzle 71 described with reference to FIGS. 8 and 9.

The nozzle 113 comprises an upper surface, the purpose of which is described in greater detail below.

Referring now to FIGS. 12 and 13, the housing 107 comprises a front face 122 and a rear face 123. In use, the housing is gripped by one hand of the marksman using the weapon, i.e. the hand gripping the housing 107 supports the fore-end of the weapon, his other hand supporting the butt-end of the weapon and controlling the trigger 102. The front face 122 comprises two spaced-apart notches 118 and 119, which assist in locating the hand correctly on the housing, thereby allowing the housing to function as a hand-grip. The upper notch 118 assists in locating the marksman's first finger (with the hand gripping to housing 107, the notch 118 rests between the first and second fingers). The lower notch 119, at the base of the housing 107 helps to locate the marksman's little finger on the hand-grip. Hence, the notches 118 arid 119 assist in locating the hand on the housing 107 in a position so that the thumb of the same hand can operate the fluid release mechanism.

The rear face 123 of the hand-grip includes an opening 109 positioned such that with the fingers clasping the front face 122, the thumb of the same hand may readily actuate the fluid release mechanism via the opening.

The housing may be substantially circular or substantially oval in cross-section. The front face 122 may comprise a flat surface extending between the notches 118 and 119, and between the notch 118 and the protruding opening 108.

In one configuration shown, the fluid ejection mechanism is actuated simply by means of the marksman inserting the thumb of his hand clasping the housing 107 into the opening 109, and pressing downwards on he surface 121 of the nozzle 113, thereby pushing the nozzle 113 onto the outlet 112 moving the outlet from the fluid retaining position to the fluid releasing position, fluid being ejected from the opening 108 in the direction of the target.

Optionally, the fluid release mechanism may include a separate trigger lever, actuable by the thumb of the marksman's hand clamping the housing 107. The trigger lever is movable between a first position in which the outlet 112 of the canister 111 is in the fluid retaining position, and a second position in which the outlet 112 of the canister 111 is in the fluid releasing position.

The trigger lever is indicated generally by reference numeral 115, and comprises at one end thereof a pad 116, and at the other end a pin 117. From FIG. 13 it can be seen that free ends of the pin 117 extend outwardly from the trigger lever 115. These free ends of the pin 117 locate in bores in the bracket 106, the lever 115 being pivotable about the pin 117.

FIGS. 12 and 13 show two different shapes of lever 115. In FIG. 12, with the trigger lever 115 in the fluid retaining position, the pad 116 occupies substantially the same plane as the axis of pin 117. To move the lever 115 to the second position and release fluid from the canister 111, the marksman must therefore push substantially downward on the pad 116 to generate movement of the nozzle 113 towards the canister 111.

In FIG. 13, with the trigger lever 115 in the fluid retaining position, the pad 116 is in plane below the plane of the axis of pin 117. The underside 133 of the lever 115 engages with the upper surface 121 of the nozzle. The difference in position of the pad 116 and the pin 117 results in the action on the pad to move the lever 115 to the second position and release fluid from the canister 111, being a substantially forward action, that is with the hand clasping the housing 107, the thumb of that hand moves towards the rear face 123 of said housing. The underside 133 of the lever 115 slides on the upper surface 121 of the nozzle, pushing the nozzle towards the canister 111.

In FIG. 13, the upper end of the housing 107, in which the nozzle 113 is located is shown with an optional cap 135, pivotably mounted in the opening 108. The cap 135 maybe pivoted into a position closing the access 136 to the nozzle 113. When the cap is closed, inadvertent release of spray is prevented. The housing 107 is provided with an internal lip portion, which co-operates with protrusions 137 to clip the cap 135 in the closed position. The cap 108 is particularly useful with the embodiment where release of fluid is achieved by the operator pressing downwards on the upper surface 121 of the nozzle 114.

The bracket 106 (shown in cross-section in FIG. 12) comprises a slot 126, the shape of which corresponds to the shape of the rail 127. The bracket 106 is slidably mounted on the rail 127, and is held in position by a grub-screw 125. The grub-screw is externally threaded and screwed into an internally threaded bore 124. By tightening the grub-screw against the underside of the rail 127, the bracket is secured in position.

The bracket 106 further comprises a bore 130 in which the housing 107 may be removably inserted. The housing 107 is held in position by four screws passing though the respective bores 131.

The bracket 106 may be formed from a plastics moulding, or from metal, and may be formed from a single piece or as two pieces, which are then secured together.

The fore-rail 105 may be formed from metal, or a plastics material. One suitable plastics material is reinforced nylon.

The housing 107 is preferably formed from plastics. This may be by moulding.

What we claim is:

1. A weapon comprising a firearm having a butt-end and a fore-end, a barrel through which a projectile may be propelled, a mechanism including a trigger for firing off said projectile, said trigger operable by a digit of a first hand of an operator, and a fluid ejection mechanism for selectively ejecting a stream of fluid in a direction substantially parallel to the axis of the barrel, wherein said fluid ejection mechanism includes a housing mounted on the fore-end of the firearm, mounted in the housing a fluid containing canister having an outlet moveable between fluid retaining and fluid releasing positions, said canister having a lip, said canister held in place by a pin passing through said housing and engaging with the underside of said lip, a nozzle mounted in the housing upstream of the outlet with fluid released from the canister passing through said nozzle, and a fluid release mechanism, and wherein said housing comprises a front face and a rear face, said front face including an opening, wherein fluid ejected through said nozzle passes through said opening, the front face further comprising a hand-grip portion, and wherein said rear face includes an opening, and wherein said fluid release mechanism is actuated through said opening and by the thumb of the operator's second hand gripping said hand-grip, said thumb closing on itself to operate said fluid release mechanism.

2. A weapon according to claim 1, wherein said fluid release mechanism comprises a lever pivotable about a pivot axis between first and second positions, and wherein with the lever in the first position the outlet of the canister is in the fluid retaining position, and with the lever in the second position the outlet of the canister is in the fluid releasing position.

3. A weapon according to claim 2, wherein the lever engages with the nozzle and during movement from the first to the second position generates movement of the nozzle towards the outlet of the canister.

4. A weapon according to claim 2, wherein the lever comprises a pad, said pad being engagable by the thumb to move the trigger from said first position to said second position.

5. A weapon according to claim 2, wherein the lever extends through the opening in the rear face of the housing.

6. A weapon according to claim 1, wherein said fluid release mechanism further comprises a pad on said nozzle, said pad engagable by said thumb, whereby exertion of a downward force on the pad by the thumb moves the nozzle towards the canister, thereby moving the outlet from the fluid retaining position to the fluid releasing position.

7. A weapon according to claim 1, wherein said fore-end comprises a rail and said housing is attached to said rail by a bracket, wherein one end of said bracket is attached to said rail and the housing is attached to the other end of said bracket.

* * * * *